US009676507B2

(12) United States Patent
Kudia

(10) Patent No.: US 9,676,507 B2
(45) Date of Patent: Jun. 13, 2017

(54) STRETCH WRAPPING SYSTEM AND PROCESS

(75) Inventor: Stephen Francis Kudia, Brookfield, IL (US)

(73) Assignee: BEST PACKAGING, INC., Brookfield, IL (US)

( * ) Notice: Subject to any disclaimer, the term of this patent is extended or adjusted under 35 U.S.C. 154(b) by 0 days.

(21) Appl. No.: 12/178,473

(22) Filed: Jul. 23, 2008

(65) Prior Publication Data

US 2010/0018165 A1 Jan. 28, 2010

(51) Int. Cl.
*B65B 1/00* (2006.01)
*B65B 11/00* (2006.01)
(Continued)

(52) U.S. Cl.
CPC ..... *B65B 65/003* (2013.01); *B65B 11/025* (2013.01); *B65B 2011/002* (2013.01); *B65B 2210/20* (2013.01)

(58) Field of Classification Search
CPC .... G01B 5/00; G01B 9/00; B65B 1/02; B65B 3/00; B65B 7/2885; B65B 11/00;
(Continued)

(56) References Cited

U.S. PATENT DOCUMENTS 2,668,404 A * 2/1954 Barefoot ..... B65B 57/08 192/12 R
4,216,640 A * 8/1980 Kaufman ..... B65B 11/045 53/556
(Continued)

FOREIGN PATENT DOCUMENTS

WO WO 2007/010341 A1 1/2007
WO WO 2008/129432 A1 10/2008

OTHER PUBLICATIONS

M.J. Maillis, Wulftec, Model WRTA-150 Non-Conveyorized Automatic Floor-Mounted Rotary Arm, Copyright 2006 Wulftec International Inc., Dist. Manual Apr. 2007, 1 page.
(Continued)

*Primary Examiner* — Andrew M Tecco
*Assistant Examiner* — Praachi M Pathak
(74) *Attorney, Agent, or Firm* — Neal, Gerber & Eisenberg LLP

(57) ABSTRACT

In one aspect, a stretch wrap system configured to separately wrap a plurality of loads in film comprising a plurality of stretch wrapping machines, each machine comprising at least one sensing mechanism configured to sense the presence of a load, and a control box electrically coupled to sensing mechanisms, the control box comprising a start button configured to start the machines when sensing mechanisms detect load. In another aspect, a process of operating a system for stretch wrapping comprising positioning at least one load to be wrapped in front of at least one of a first and second machine wherein the first machine includes a sensing mechanism electrically coupled to a control box and wherein the second machine includes a second sensing mechanism electrically coupled to the control box, inputting a start signal through the control box, transmitting a signal from the control box to each of the sensing mechanisms, determining the presence or absence of a load within an operational space of each of the plurality of stretch wrapping machines and wrapping each present load using a respective one of the plurality of stretch wrapping machines.

13 Claims, 7 Drawing Sheets

(51) Int. Cl.

| | |
|---|---|
| ***B65B 57/12*** | (2006.01) |
| ***B65B 57/00*** | (2006.01) |
| ***B65B 57/08*** | (2006.01) |
| ***B65B 57/16*** | (2006.01) |
| ***B65B 57/10*** | (2006.01) |
| ***B65B 65/00*** | (2006.01) |
| ***B65B 11/02*** | (2006.01) |

(58) Field of Classification Search

CPC ..... B65B 11/025; B65B 57/10; B65B 57/12; B65B 65/006; B65B 2210/20; B65B 57/00; B65B 57/02; B65B 57/08; B65B 57/16

USPC ..... 53/441, 556, 52, 504, 211, 218, 399, 64, 53/73, 74, 588, 202; 29/700–714; 198/571–572; 700/213, 228, 229, 230, 9, 700/11, 13, 28

See application file for complete search history.

(56) References Cited

U.S. PATENT DOCUMENTS

| | | | | | |
|---|---|---|---|---|---|
| 4,248,031 | A | | 2/1981 | Del Pozo, Jr. | |
| 4,432,185 | A | * | 2/1984 | Geisinger | B65B 11/045 53/138.2 |
| 4,458,467 | A | | 7/1984 | Shulman et al. | |
| 4,563,863 | A | * | 1/1986 | Humphrey | B65B 11/045 53/556 |
| 4,718,219 | A | | 1/1988 | Schmitz | |
| 4,722,170 | A | * | 2/1988 | Ball | B65B 11/025 53/556 |
| 4,747,254 | A | * | 5/1988 | Lancaster | B65B 41/12 226/92 |
| 4,809,481 | A | * | 3/1989 | Fruh | B65B 65/003 53/452 |
| 4,862,678 | A | * | 9/1989 | Humphrey | 53/556 |
| 4,905,448 | A | * | 3/1990 | Plitt | B65B 11/025 53/176 |
| 4,938,008 | A | * | 7/1990 | Salzsauler | B65B 11/025 53/556 |
| 5,005,335 | A | * | 4/1991 | Yourgalite | B65G 61/00 53/399 |
| 5,082,103 | A | * | 1/1992 | Ross | B65G 47/31 198/460.1 |
| 5,163,264 | A | * | 11/1992 | Hannen | B65B 11/025 53/389.2 |
| 5,315,809 | A | * | 5/1994 | Gordon | B65B 11/025 53/399 |
| 5,414,979 | A | | 5/1995 | Moore et al. | |
| 5,539,977 | A | * | 7/1996 | Kano et al. | 29/833 |
| 5,572,850 | A | * | 11/1996 | Lancaster, III | B65B 11/045 53/389.3 |
| 5,581,979 | A | | 12/1996 | Scherer | |
| 5,603,198 | A | | 2/1997 | Rimondi et al. | |
| 5,765,344 | A | * | 6/1998 | Mandeville | B65B 11/025 53/389.3 |
| 5,794,418 | A | | 8/1998 | Lai | |
| 5,797,240 | A | | 8/1998 | Martin-Cocher et al. | |
| 5,799,471 | A | | 9/1998 | Chen | |
| 5,836,140 | A | * | 11/1998 | Lancaster, III | 53/399 |
| 5,941,049 | A | | 8/1999 | Lancaster, III et al. | |
| 6,006,498 | A | | 12/1999 | Cleine | |
| 6,070,393 | A | | 6/2000 | Martin-Cocher et al. | |
| 6,170,776 | B1 | | 1/2001 | Martin-Cocher et al. | |
| 6,253,532 | B1 | | 7/2001 | Orpen | |
| 6,276,116 | B1 | | 8/2001 | Annila et al. | |
| 6,360,512 | B1 | * | 3/2002 | Marois | B65B 11/006 53/399 |
| 6,370,839 | B1 | * | 4/2002 | Nakagawa | B65B 11/008 52/211 |
| 6,383,430 | B1 | | 5/2002 | Johnstone | |
| 6,502,373 | B1 | * | 1/2003 | Tipton et al. | 53/504 |
| 6,516,234 | B2 | * | 2/2003 | Kamiguchi et al. | 700/20 |
| 6,713,010 | B1 | | 3/2004 | Doran et al. | |
| 6,848,240 | B2 | | 2/2005 | Frey | |
| 7,089,713 | B2 | | 8/2006 | Lancaster, III et al. | |
| 7,178,317 | B1 | * | 2/2007 | Koskela | B65B 41/12 242/597.8 |
| 7,269,935 | B2 | | 9/2007 | Jafari | |
| 7,540,128 | B2 | | 6/2009 | Lancaster, III et al. | |
| 7,621,107 | B2 | | 11/2009 | Vanderheiden et al. | |
| 2005/0023321 | A1 | * | 2/2005 | Tsai | 227/78 |
| 2006/0243842 | A1 | | 11/2006 | Saldana Garcia | |
| 2007/0051075 | A1 | * | 3/2007 | Chiu Chen | 53/504 |
| 2008/0164278 | A1 | * | 7/2008 | Myerscough | 221/69 |
| 2008/0295461 | A1 | * | 12/2008 | Parmley | B65B 57/12 53/461 |
| 2009/0094942 | A1 | | 4/2009 | Cousins et al. | |
| 2009/0120307 | A1 | * | 5/2009 | Koskela | B65B 11/025 100/27 |
| 2010/0205910 | A1 | | 8/2010 | Huyghe | |
| 2010/0300049 | A1 | | 12/2010 | Schmidt et al. | |

OTHER PUBLICATIONS

M.J. Maillis, Wulftec; http://www.wulftec.com/brochures/WulftecAutomaticRotaryArms_English.pdf; WRTA-150 Stretch Wrapper, Jan. 29, 2009, 2 pages.

* cited by examiner

STRETCH WRAPPING SYSTEM AND PROCESS

BACKGROUND OF THE INVENTION

1. Field of the Invention

The present invention is directed to a system and process for wrapping a plurality of loads to improve efficiency and increase the speed with which the loads can be wrapped and then transported.

2. Description of the Related Art

Stretch wrapping of loads on pallets used to be done by hand, with an operator unrolling the wrap, winding the wrap around the load, cutting the wrap and making sure it adhered to the load. This process was time consuming, inefficient and wasteful.

In time, stretch wrapping machines were developed to speed up the process, automating each step described above. In addition, the machines could stretch the wrap, thereby pre-tensioning it, which has two benefits. First, a stretched wrap requires less wrap to fully encompass a load, meaning less material needs to be used per wrapping. Second, the pretensioning causes the wrap to pull inwards on itself, causing the load to be more securely wrapped, resulting in more stable transport. However, even with the use of stretch wrapping machines, if an operator wished to wrap more than one pallet of material at a time, he would have to set up each pallet in front of separate machines and control each machine separately or he would have to use a conveyorized system What is needed is a system and process for stretch wrapping that takes advantage of the benefits of stretch wrapping machines while further increasing their efficiency and productivity.

BRIEF SUMMARY OF THE INVENTION

In one aspect of the invention, a stretch wrap system configured to separately wrap a plurality of loads in film may have a plurality of stretch wrapping machines, each machine comprising at least one sensing mechanism configured to sense the presence of a load, and a control box electrically coupled to sensing mechanisms, the control box comprising a start button configured to start the machines when the sensing mechanisms detect load. In one embodiment, each of the sensing mechanisms may be a photo eye. In addition, each sensing mechanism may further sense the height of the load. To do this, the sensing mechanisms may use one or more infrared light signals to determine the presence and height of the load by calculating the presence or lack of reflectivity or the time for reflection of the light signals.

In another aspect of the invention, a process of operating a system for stretch wrapping having a plurality of stretch wrapping machines, the process comprising positioning at least one load to be wrapped in front of at least one of a first and second machine wherein the first machine includes a sensing mechanism electrically coupled to a control box and wherein the second machine includes a second sensing mechanism electrically coupled the control box; inputting a start signal through the control box; transmitting a signal from the control box to each of the sensing mechanisms; determining the presence or absence of a load within an operational space of each of the plurality of stretch wrapping machines; and wrapping each present load by a respective one of the plurality of stretch wrapping machines. This process may further include the step of determining a height of each present load within an operational space of each of the plurality of stretch wrapping machines.

These and other features and advantages are evident from the following description of the present invention, with reference to the accompanying drawings.

DETAILED DESCRIPTION

Figure 1:
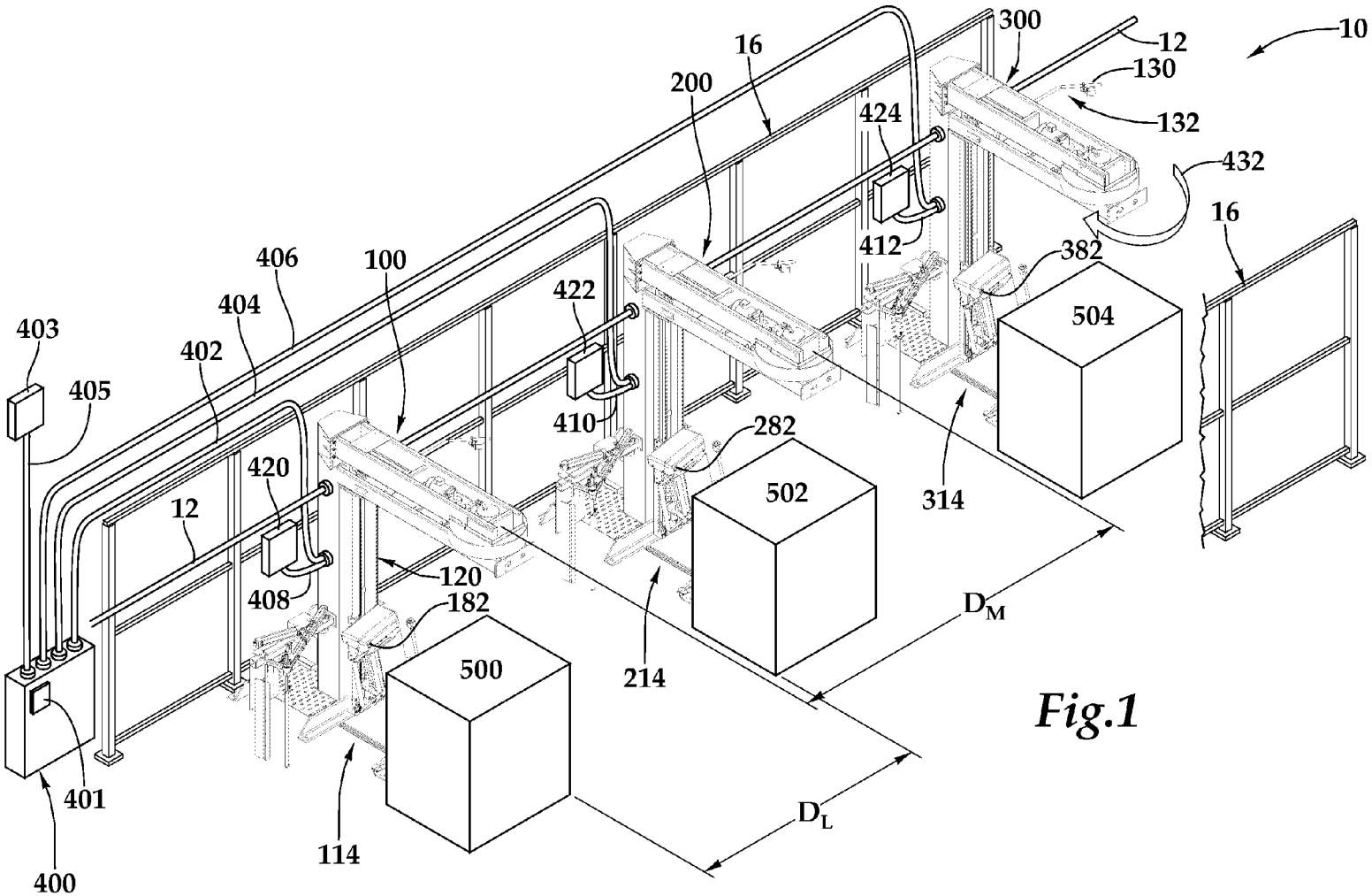
FIG. 1 is a perspective view of stretch wrapping system.

Stretch wrap system 10 is a system configured to wrap at least one load on a pallet, a slipsheet, or other suitable surface, preferably more than one load substantially simultaneously, to increase wrapping efficiency by decreasing the time it takes a user to prepare, wrap and remove each load. System 10 includes at least one stretch wrap machine 100, preferably a plurality of stretch wrap machines, still more preferably at least two stretch wrap machines 100 and 200, and in one embodiment, system 10 may include at least three stretch wrap machines 100, 200 and 300. In one embodiment, system 10 includes more than three stretch wrapping machines. System 10 is configured such that machines 100, 200 and/or 300 are in electrical communication such that one load 500, two loads 500, 502 and/or three loads 500, 502, 504 may be wrapped in stretch film substantially simultaneously or in series.

Machine Components

Referring to FIG. 1, machines 100, 200 and 300 may be positioned generally in line with each other. Preferably, machines 100, 200 and 300 may be positioned generally coaxially with one another along axis 12 such that the front 114, 214, 314 of each machine 100, 200 and 300 is configured to receive a load and fronts 114, 214, 314 are generally in line with each other. Machines 100, 200, and/or 300 may be of similar size or have different sizes depending upon the size of the loads intended to be wrapped.

In one embodiment, machines 100, 200 and 300 are positioned a distance $D_M$ apart. Specifically, distance $D_M$ is defined between the approximate centers of consecutive machine ring gears 167 (described herein). In one embodiment, distance $D_M$ may be a distance between about 3' and about 45', preferably between about 10' and about 30', and more preferably about 12'. Distance $D_M$ may be defined at least partially by the size of each load, the size of each machine, and the size of modular arm 164 (described herein) to prevent machines from damaging one another. Furthermore, a distance $D_L$ is defined between consecutive load surfaces. For example, distance $D_L$ is defined between outer surfaces of loads 500 and 502, as shown in FIG. 1. In one embodiment, distance $D_L$ may be a distance between about 1' and about 50', preferably between about 5' and about 25', and more preferably about 10'. Moreover, distance $D_L$ may be defined at least partially by the size of each load, the size of each machine, and the size of modular arm 164 (described herein) to prevent machines from damaging one another and to enable enough space for the machines to properly stretch wrap each load such that system 10 operates as described herein. A timing sequence between the machines may be prearranged so that the machines do not interfere with the operation of one another when more than one machine is in operation. The timing sequence may enable machines to be placed closer together such that the wrap diameters of the machines overlap. Additionally, system 10 may include safety fencing 16. The dimensions and position of safety fencing 16 may change based upon the layout of the plant and/or facility that houses system 10.

Figure 2:
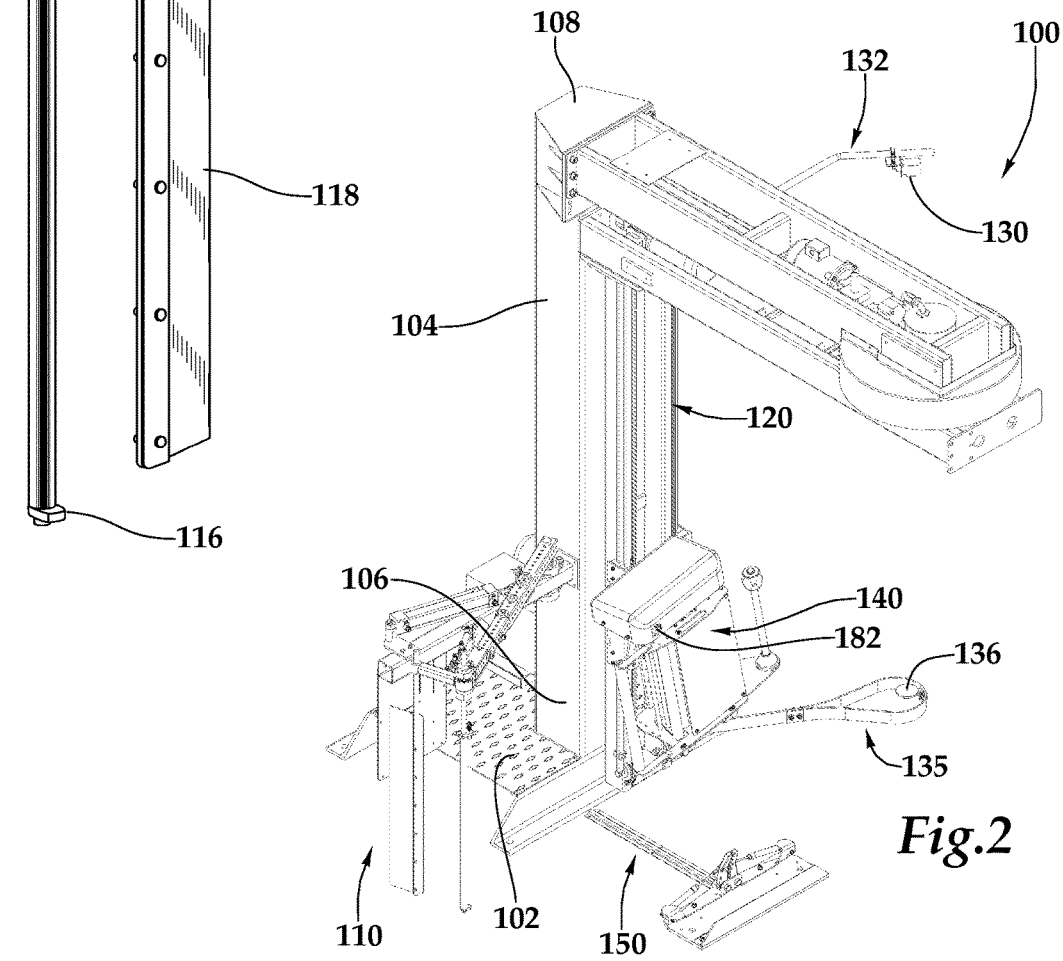
FIG. 2 is a perspective view of a stretch wrapping machine of FIG. 1.

Referring to FIG. 2, at least one machine 100 includes a base 102 configured to be positioned on the ground and at least one stand 104 having a first end 106 and an opposing second end 108 wherein first end 106 is coupled to base 102. In one embodiment, base 102 and stand 104 may be substantially perpendicular to one another. In one embodiment, stand 104 may have a height between about 50" and about 200", preferably between about 100" and about 150", and more preferably about 141". Stand height 104 may vary depending upon the height of the load or the 'wrap height'. For example, a wrap height of about 104" may have a stand height of about 141". In another embodiment, machine 100 may be a turntable stretch wrap machine wherein a load to be stretch wrapped would be placed upon a turntable.

Figure 3:
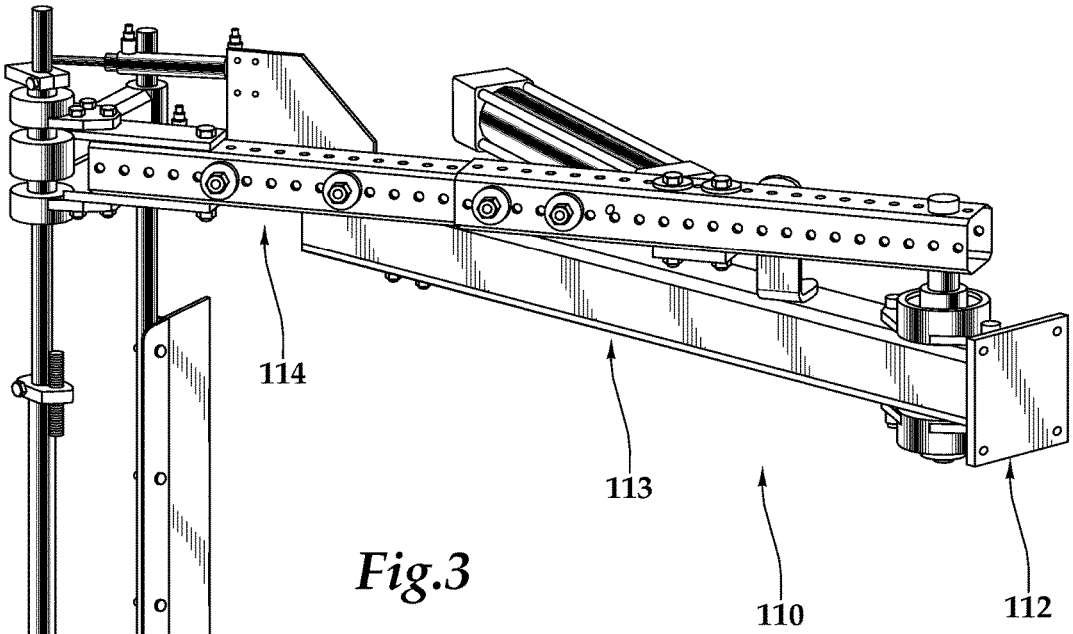
FIG. 3 is a perspective view of a film cutting and wiping system.

Referring to FIG. 3, system 10 includes at least one machine 100 that may include a stretch film wipe system 110. In one embodiment, wipe system 110 is configured to cut and wipe stretch film 142 after machine 100 has completed a wrap cycle and wrapped load 500. In one embodiment, wipe system 110 is coupled proximate stand first end 106. Stretch film wipe system 110 is configured to eliminate the need to attach and cut film 142 manually, saving time and costs. Further, the wipe system 110 generally eliminates film tails. Specifically, wipe system 110 may include an attachment 112 that may be coupled to stand 104, a substantially stationary arm 113 that may be coupled to attachment 112, a movable arm 114 that may be coupled to stationary arm 113, a heat impulse wire 116 and a wiper 118 that both may be coupled to arm 114 and may extend substantially perpendicular therefrom. Arm 114 is configured to extend out towards the load. After the wrap cycle is completed, heat impulse wire 116 turns on momentarily to cut the film 142, and wiper 118 extends out to wipe film 142 on the pallet and/or the rest of the load 500. Wiper 118 may be replaced with other items depending on the type of load being wrapped. For example, wiper 118 may be a brush (shown in FIG. 3) when the load has flat, even sides. Wiper 118 may be a series of plastic bumpers (not shown), mounted one on top of another, when the load is irregularly shaped. In another embodiment, wipe system 110 may be any wipe system that performs the substantially same function.

Figure 4:
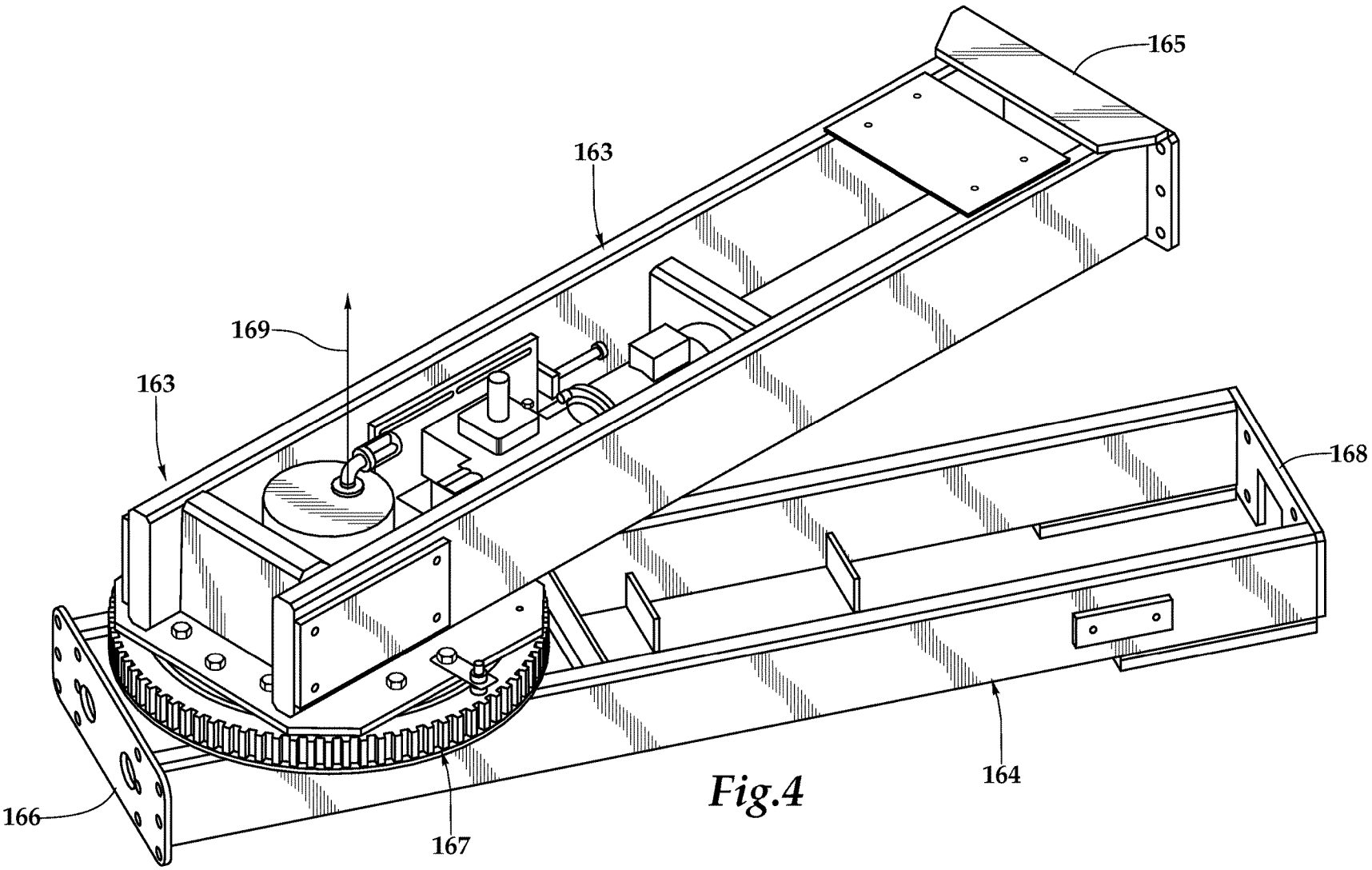
FIG. 4 is a perspective view of a revolving top frame used in the stretch wrap system of FIG. 1.

Turning to FIG. 4, which is a perspective view of a top frame 160 of machine 100, top frame 160 may couple to at least one of a boom arm 120 (shown in FIG. 5) and/or stand 104. In one embodiment, top frame 160 has an upper portion 162 and a lower portion or modular arm 164. Upper portion 120 has a first end 163 and an opposing second end 165 configured to couple to stand 104, and modular arm 164 has a first end 166 and an opposing second end 168. Top frame 160 also has a ring gear 167 coupled between upper portion 162 and modular arm 164 proximate first end 166 such that modular arm 164 may rotate with respect to upper portion 120. In one embodiment, ring gear 167 is a belt drive. Specifically, ring gear 167 may rotate modular arm 164 along an axis 169 such that second end 168 rotates freely. In one embodiment, axis 169 is substantially parallel to stand 104. As second end 168 rotates around axis 169, it creates a wrap diameter (not shown). Wrap diameter is a function of the size of modular arm 164 and the size of the load. As such, the wrap diameter must be larger than the size of the load. In one embodiment, the wrap diameter may be between about 20" and 100", preferably between about 40" and 80", and, in one embodiment, about 68".

Machine 100 may further comprise a ring gear cover (not shown) configured to cover ring gear 167. The ring gear cover may include a flange (not shown) configured to engage at least one of upper portion 162 and/or modular arm 164 when the cover is coupled to gear 167.

Figure 5:
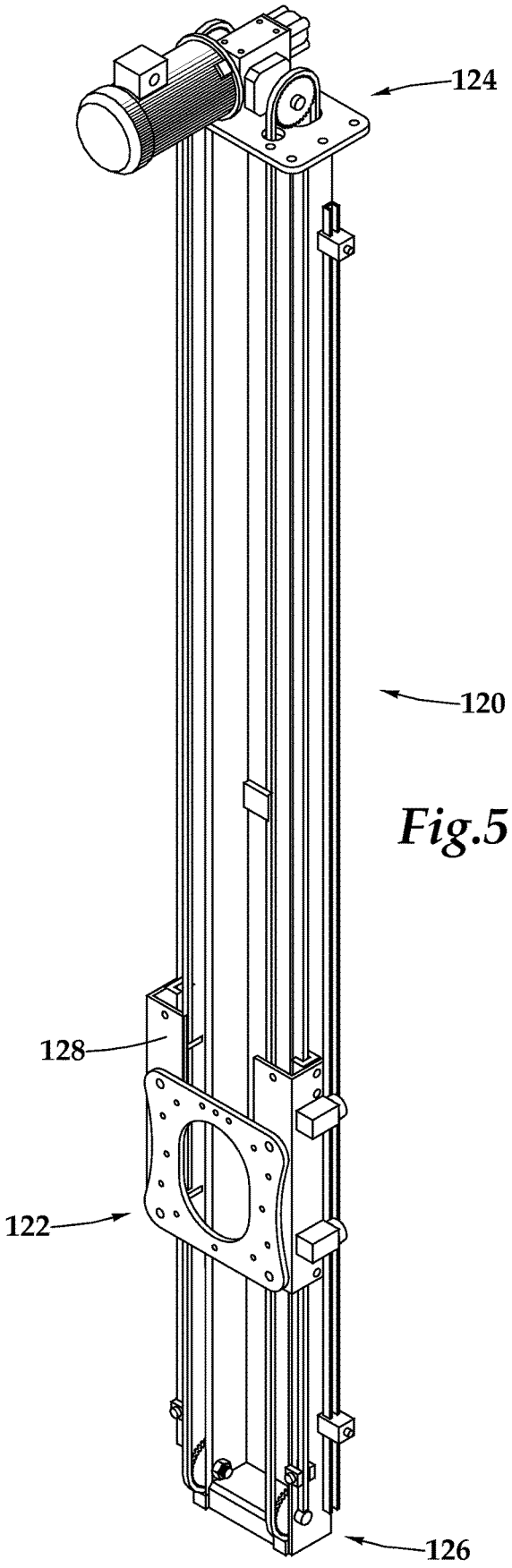
FIG. 5 is a perspective view of a revolving boom arm used in the stretch wrap system of FIG. 1.

Referring to FIG. 5, machine 100 may also include a boom arm 120 that may include a film prestretch carriage holder 122 configured to hold a carriage 140 (shown in FIG. 6) that may carry stretch film 142 and that may be coupled to second end 168 of modular arm 164. Boom arm 120 may also include a motor and/or gear designed and configured to vary the position of carriage holder 122 and/or carriage 140, for example, translationally between boom arm top 124 and boom arm bottom 126. Specifically, boom arm 120 may raise carriage holder 122 and/or carriage 140 proximate the top of the load, may lower carriage holder 122 and/or carriage 140 proximate the bottom of the load, and/or may position carriage holder 122 and/or carriage 140 therebetween. Machine 100 may also include a bracket 128 having guides to facilitate maintaining carriage 140 substantially aligned with length of boom arm 120.

Machine 100 may further include an arm 132 and at least one photo eye 130 wherein arm 132 is preferably coupled near boom arm top 124. Photo eye 130 may be a safety photo eye that is in electrical communication with machine 100 and may partially control the position of boom arm 120, carriage holder 122, and/or carriage 140. Specifically, photo eye 130 emits an infrared beam of light that is intended to be detected by a reflector 136 coupled to a flexible plastic bumper 135 (shown in FIG. 2), such that photo eye 130 generally is directed towards the reflector 136. Bumper 135 is preferably coupled near boom arm bottom 126. After photo eye 130 emits an infrared beam of light, if the infrared beam is interrupted, such that the infrared beam of light is not detected by the reflector 136, a signal is transmitted to stop boom arm 120. Alternatively, photo eye 130 may be a bumper to enhance the safety of machine 100.

Figure 6:
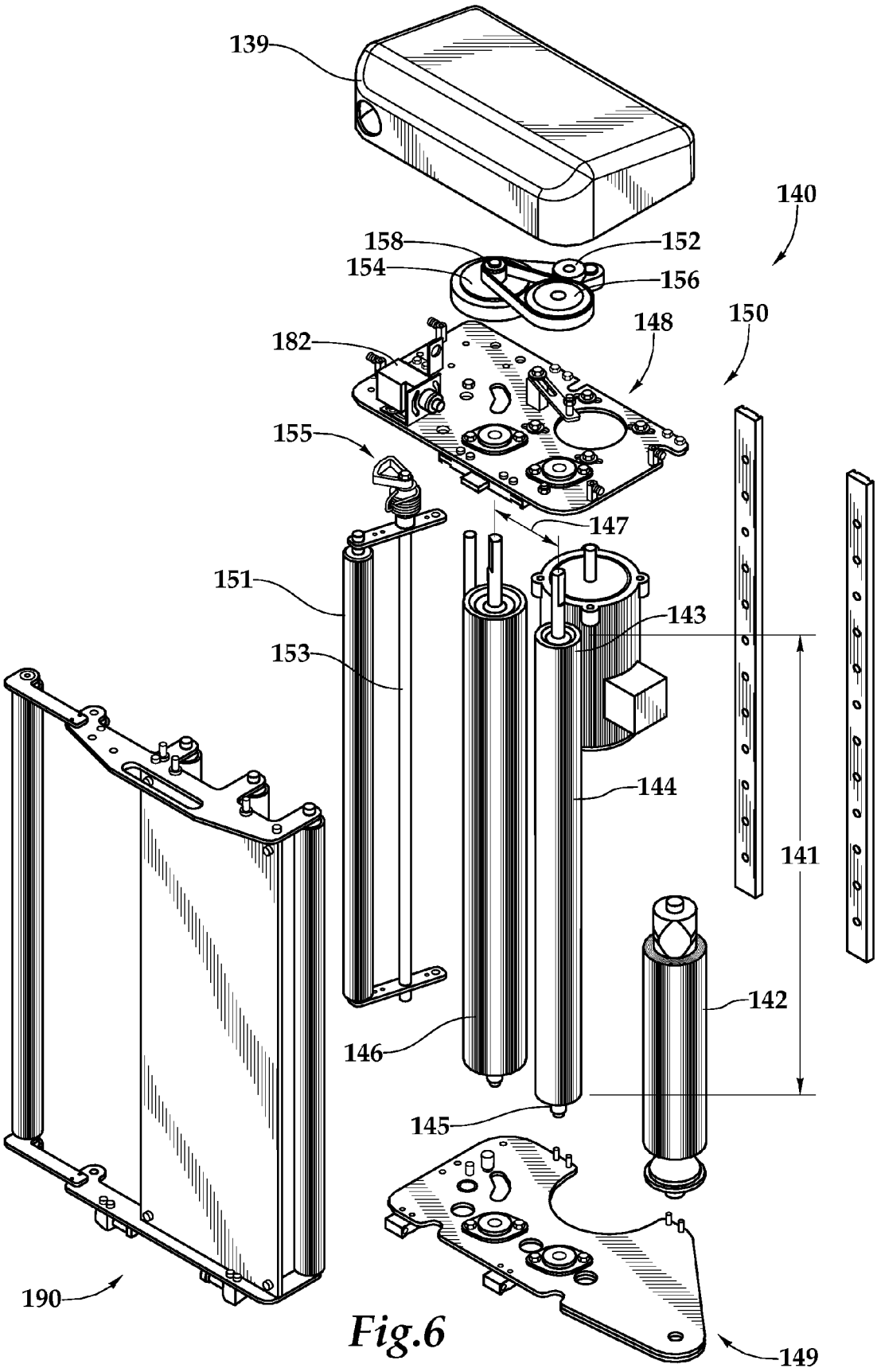
FIG. 6 is an exploded view of a carriage used for housing, prestreching, and applying stretch wrap.
Figure 7:
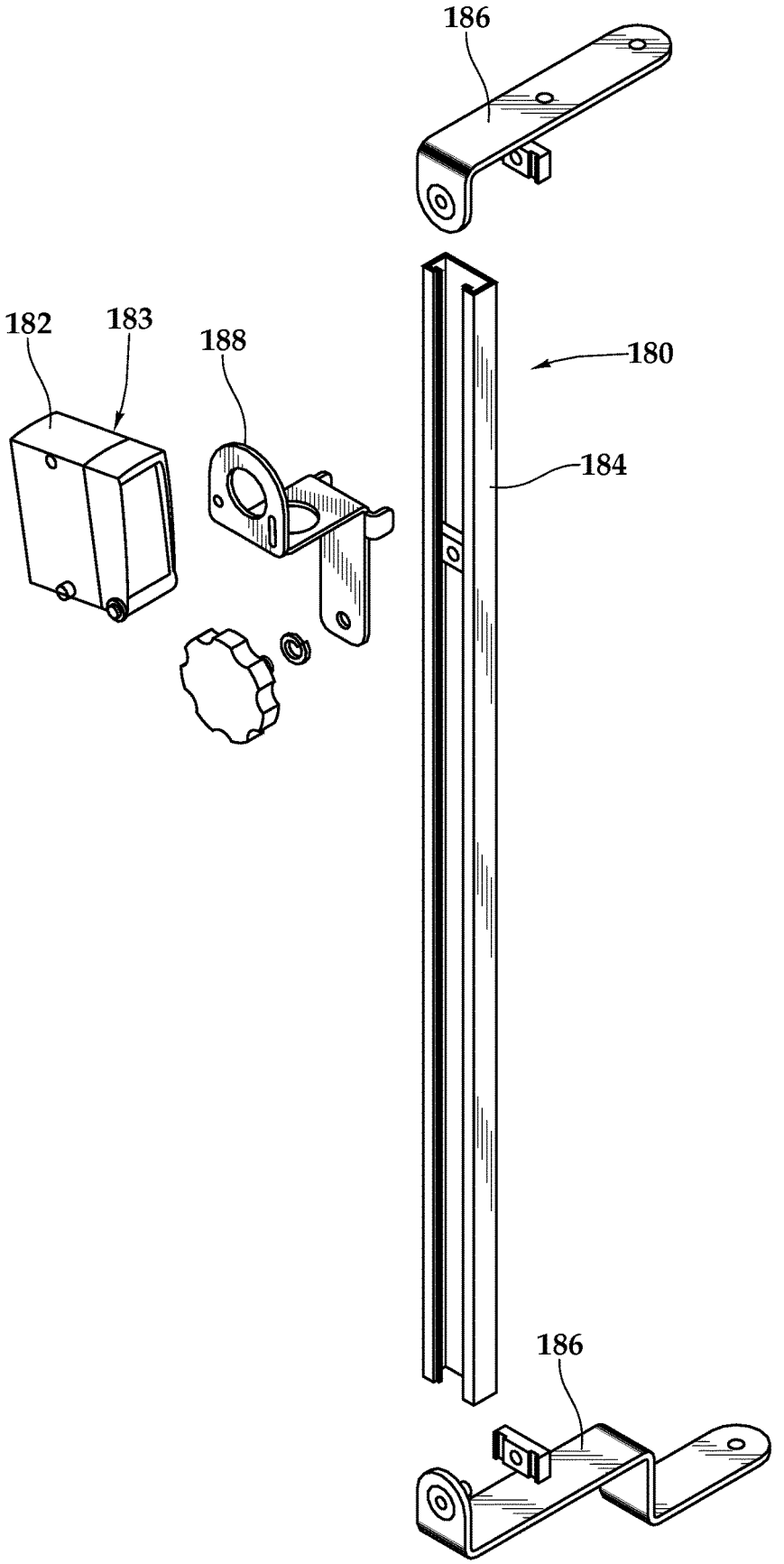
FIG. 7 is an exploded view of a sensing apparatus and attachment mechanism.

Referring to FIG. 6, machine 100 also includes at least one prestretch carriage 140 configured to move along boom arm 120 to apply a spiraling layer of prestretched film 142 to the load to encapsulate the load in film 142. Carriage 140 may be coupled to prestretch carriage holder 122 on boom arm 120.

In addition to applying a layer of film 142 to a load, prestretch carriage 140 is configured to stretch film 142 prior to applying film 142 to the load to be wrapped. Stretch film 142 passes through carriage 140, threading past at least two rubber rollers, a primary roller 144 and a secondary roller 146, with a distance 147 extending therebetween. Each roller 144 and 146 has a height 141 extending between a first end 143 and a second end 145 and are coupled together by a carriage top plate 148 and an opposing carriage bottom plate 149. Height 141 may vary depending on the size of film 142. A carriage cover 139 may be coupled to a portion of top plate 148 to at least partially cover the top of carriage 140.

Primary and secondary rollers 144 and 146 are generally rubberized rollers that film 142 passes by and are used to stretch film 142 prior to applying film 142 to the load. Secondary roller 146 is generally larger than primary roller 144 and may be designed to rotate generally faster primary roller 144, for example through the use of a gear differential between primary roller 144 and secondary roller 146. The speed differential of secondary roller 146 pulls film 142 from primary roller 144, stretching film 142 between rollers 144 and 146 into prestretch film 142. For example, prestretch carriage 140 may stretch approximately 10" of film 142 into approximately 40" of prestretch film 142. Stretching film 142 prior to applying film 142 to the load decreases the amount of film 142 necessary to wrap the load and also activates the film memory effect causing film 142 to want to stretch back to its original length after it is applied to the load, thereby film 142 tightens around the load and securely holds the load.

Prestretch carriage 140 may also include a prestretch carriage dancer bar assembly 151 including a dancer bar 153 that is loaded, preferably spring loaded, with a cam near top 155. Dancer bar assembly 151 is configured to allow more film 142 to feed at corners of the load to prevent film 142 from tearing. Carriage 140 may include a sensor (not shown) that reads the distance between the cam and the sensor. As the cam moves further from the sensor, the prestretch carriage motor will turn faster thereby enabling carriage 140 to feed film 142 faster. Alternatively, switches and/or load cells may be used to vary the speed in which film 142 is fed.

Additionally, prestretch carriage 140 may further have a film carriage door 190. Door 190 is configured to push film 142 against rollers 144 and 146 to maintain contact between the film 142 and rollers 144 and 146 for prestretch tensile consistency.

Staying with FIG. 6, prestretch carriage 140 may further include a top plate 148 and multiple gear belt pulleys 152, 154, 156, and 158. Gear belt pulley 152 may preferably have a slightly smaller bore than pulleys 154, 156, and 158. In one embodiment, the size of pulleys 154, 156, and 158 have bores that are substantially the same size. Pulleys 152 may have a bore size between about 0.1 inch and about 2 inches, preferably between about 0.5 inch and 1.5 inches, and more preferably about 0.625 inch. Pulleys 154, 156, and 158 each may have a bore size between about 0.1 inch and about 2 inches, preferably between about 0.5 inch and 1.5 inches, and more preferably about 0.75 inch. Changing the size of gear belt pulleys enables the degree of prestretch to change from about 50% to about 300%.

Turning back to FIG. 1, machine 100 may also include a film clamp 150 for holding film 142 upon the start of boom arm 120 (shown in FIG. 5). Clamp 150 enables machine 100 to operate automatically such that no operator intervention is required to adhere film 142 to load or to prestretch film 142 upon start of machine 100. Without clamp 150, an operator would need to manually attach film 142 to the load prior to starting machine 100.

Sensing Mechanism

Referring to FIGS. 6, 7, 8, and 9, machine 100 may further include at least one sensing mechanism 182 designed to sense the presence of a load to start machine 100. Sensing mechanism 182 may be an electric or electronic photo eye, a load sensor, a scale, an accelerometer or any other apparatus that may detect the existence of a load in the wrapping zone. In the embodiment shown in at least FIG. 6, sensing mechanism 182 is a photo eye that emits an infrared beam of light and contains a sensor to detect the reflection of the beam to determine if a load is present. Sensing mechanism 182 is further designed to sense the height and/or the top of the load to prevent carriage 140 from continuing to wrap above the load. If sensing mechanism 182 is a photo eye, the type of photo eye used with machine 100 may vary depending on various factors such as the environment of machine 100, how much light is around machine 100, and the color and/or reflectivity of the load.

In one embodiment, sensing mechanism 182 may include a first photo eye (not shown) and a second photo eye (not shown). In this embodiment, the first photo eye would be configured to detect the presence of a load, and the second photo eye would detect the height of the load.

Sensing mechanism 182 may mechanically detect the presence and height of a load. Preferably, however, sensing mechanism 182 may operate electrically, which may result in more accurate results and a longer life cycle for sensing mechanism and may allow for easier operation of machine 100 by routing a signal from sensing mechanism 182 to a single control box that also controls the wrapping functions of machine 100.

In one embodiment, sensing mechanism 182 may be coupled to prestretch carriage 140, preferably proximate the top of carriage 140. For example, sensing mechanism 182 may be coupled to carriage cover 139 and/or coupled to carriage top plate 148.

In another embodiment, sensing mechanism 182 may be coupled to a sensing mechanism mounting apparatus 180 configured to couple to prestretch carriage 140. Apparatus 180 may include at least one sensing mechanism housing 183, at least one strut 184, at least one plate 186 configured to couple between strut 184 and machine 100, at least one flange 188 configured to mount sensing mechanism 182 and sensing mechanism housing 183 to strut 184 wherein flange 188 may be moved along strut 184. In one embodiment, at least one plate 186 is configured to couple to carriage cover 139. In one embodiment, apparatus 180 is used when prestretch carriage 140 is approximately 30" tall and the load is less than approximately 30" tall. Further, in one embodiment, sensing mechanism 182 is a photo eye designed to detect dark and shiny loads.

Sensing mechanism 182 may be electrically coupled to a control box. Control box may receive a command signal from a user to begin a wrapping process. Before executing that process, control box may acquire or receive one or more signals from sensing mechanism that verify that a load has been placed within the wrapping area and that determine the height of that load.

Plurality of Machines

As discussed above, and shown in FIG. 1, system 10 comprises a plurality of machines. Preferably, machines 100, 200 and/or 300 have substantially similar components and/or processes of operation. However, machines may be both structurally and operationally distinct, provided that each machine 100, 200 and/or 300 wraps a load placed in front of it and has a sensing mechanism 182, 282 and 382 to determine the presence and/or height of the load. Machines 100, 200 and/or 300 may be electrically coupled to one another to facilitate decreasing the time to wrap multiple loads to increase the efficiency of system 10.

Each machine 100, 200, and 300 includes at least one sensing mechanism, 182, 282, 382. In the embodiment shown in FIG. 1, machine 200 includes at least one sensing mechanism 282 that is substantially similar to sensing mechanism 182, and machine 300 includes at least one sensing mechanism 382 that is substantially similar to sensing mechanism 182. In this embodiment, sensing mechanisms 182, 282 and 382 are photo eyes, and each is designed to emit an infrared beam of light to sense the presence of a load to start machines 100, 200 and/or 300 and is further designed to sense the height of each load placed in front of machines 100, 200, and/or 300 to be wrapped.

System 10 further includes at least one master control box 400 that is in electric or electronic communication with at least one sensing mechanism 182, 282 and/or 382. At least one conduit 402 is coupled between sensing mechanism 182 and control box 400, at least one conduit 404 is coupled between sensing mechanism 282 and control box 400, and at least one conduit 406 is coupled between sensing mechanism 382 and control box 400. In one embodiment, system 10 may include a wireless communication and/or signal to facilitate communication between sensing mechanisms 182, 282, and/or 382 and control box 400 rather than conduits. In a further embodiment, communication between sensing mechanisms 182, 282, and/or 382 and control box 400 may include infrared or radio frequency signals to facilitate communication.

Figure 9:
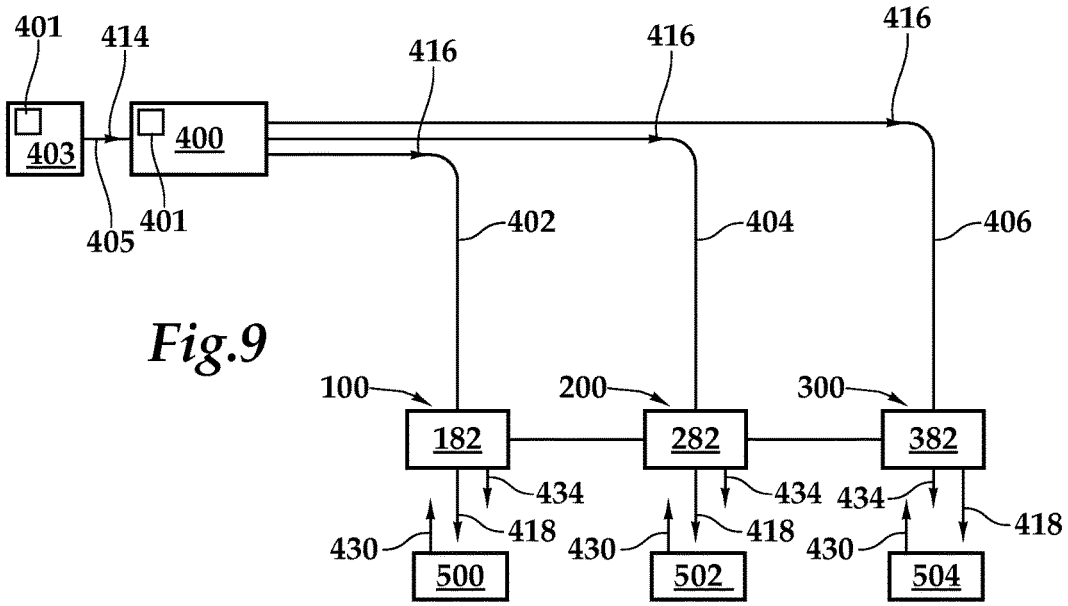
FIG. 9 is a schematic of a control box and sensing apparatus.

As shown in FIG. 9, sensing mechanisms 182, 282 and 382 may be electrically coupled to each other and to control box 400. In one embodiment, sensing mechanisms may be connected serially so that operation of system 10 is dependent on loads 500, 502, 504 being present in front of each of machines 100, 200 and 300. Preferably, however, sensing mechanisms 182, 282, 382 are connected in parallel so that machines 100, 200 and 300 may operate independently. For example, the presence of loads 500, 502 in front of machines 100 and 200, respectively, will cause loads 500, 502 to be wrapped while the presence of no load in front of machine 300 will cause machine 300 to take no action.

Master control box 400 further may include at least one start button 401 such that when start button 401 is triggered, master control box 400 may start each machine 100, 200 and/or 300 depending on the signal or signals received from each sensing mechanism 182, 282 and/or 382. In one embodiment, master control box 400 may not include start button 401, but rather a separate control box 403 electrically coupled to master control box 400 via a conduit 405 may include start button 401.

Additionally, master control box 400 may have a touch screen (not shown) enabling a user to touch the screen to operate and control various functions of system 10 through master control box 400.

Figure 8:
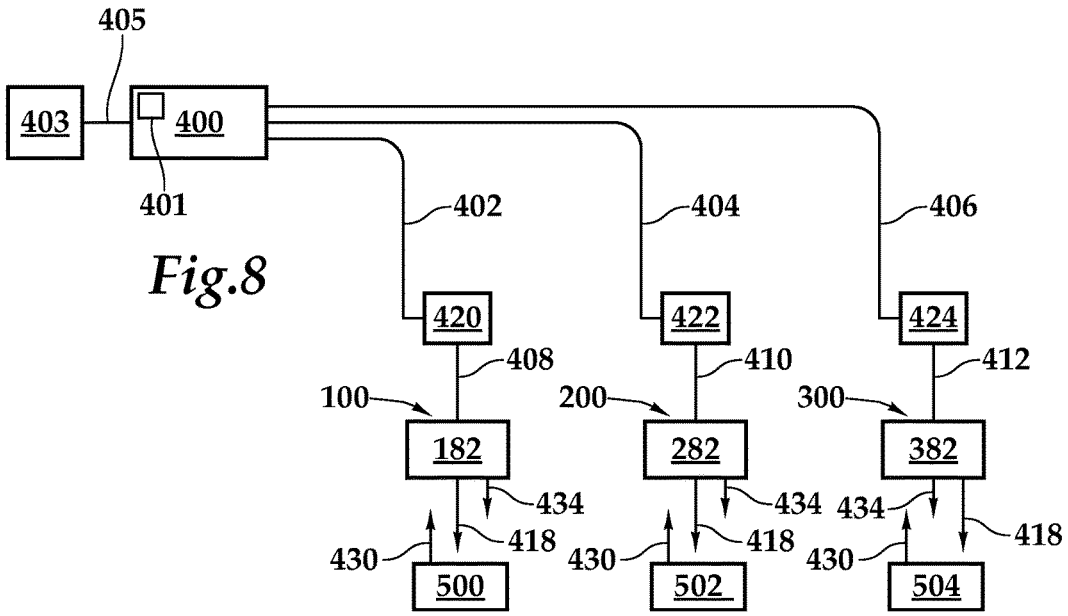
FIG. 8 is a schematic of a control box and sensing apparatus.

As shown in FIG. 8, system 10 may further include individual control boxes 420, 422 and/or 424 for each machine 100, 200 and/or 300, respectively, alternatively or in addition to master control box 400. Each control box 420, 422 and/or 424 may include a start button (not shown). Each control box 420, 422 and/or 424 may be in electronic communication with each respective sensing mechanism 182, 282 and/or 382 via conduits 408, 410 and/or 412, respectively. Further, each control box 420, 422 and/or 424 may be in electronic communication with master control box 400 such that each control box 420, 422 and/or 424 operate in conjunction with one another.

Method of Operation

During operation, a forklift operator may drop at least one load on a pallet in front of at least one machine 100, 200, and/or 300 so that the load can be wrapped in film 142. For example, the forklift operator may drop at least one of three loads 500, 502, and/or 504 in front of machines 100, 200, and/or 300 such that each load may be wrapped. In one embodiment, the forklift operator may drop at least one of three loads 500, 502, and/or 504 from a forklift, a single pallet jack, a double pallet jack, a triple pallet jack, a quadruple pallet jack, and/or another suitable machine that enables a forklift driver to transport loads and/or pallets. A single pallet jack may enable a forklift operator to carry a single load, and a double, triple, and/or quadruple pallet jack may enable a forklift driver to carry or transport more than one load at a time. At the present time, a forklift operator can carry a maximum of three loads with each load having a width and a length of no more than about 15'. Each load 500, 502, and/or 504 may be of varying sizes. If the forklift operator is transporting more than one load at a time, the operator may not drop each load consecutively. Specifically, forklift operator may drop first load 500 in front of machine 100, forklift operator may drop second load 502 in front of machine 200, and forklift operator may drop third load 504 in front of machine 300, leaving space between each of the loads, and the forklift operator then drives from machine 300 to at least one of the master control box 400 and/or control box 403.

Forklift operator may then start system 10 by pressing start button 401 to start at least one of machines 100, 200 and/or 300. Specifically, in one embodiment, the fork lift operator presses start button 401 on separate control box 403 that transmits a signal 414 to master control box 400 via a conduit 405. Master control box 400 then receives signal 414 and transmits at least one signal 416 to machines 100, 200 and/or 300 via each respective conduit 402, 404 and/or 406. Alternatively, forklift operator may start system 10 by pressing a separate start button (not shown) on each separate machine 100, 200, and/or 300 to start each respective machine.

Once machines 100, 200 and/or 300, specifically sensing mechanisms 182, 282 and/or 382, receive signal 416, each sensing mechanism 182, 282 and/or 382 determines whether a load is present. In the case where sensing mechanisms 182, 282 and 382 are photo eyes, sensing mechanisms 182, 282 and 382 each emit an infrared beam of light 418 towards the front 114 of each machine 100, 200, 300 to sense whether a load is present. If beam of light 418 refracts back to sensing mechanisms 182, 282 and/or 382, or depending on the time it takes for beam of light 418 to refract, sensing mechanisms 182, 282, 382 may determine that a load is present. Each sensing mechanism 182, 282 and/or 382 that received a refracted signal may then transmit a start signal 430 to start each respective machine 100, 200, and/or 300. If beam of light 418 is not refracted back to sensing mechanisms 182, 282 and/or 382, or if the light's refraction time signifies that no load is present, then machine 100, 200 and/or 300 assumes that a load is not present and does not need to be wrapped and sensing mechanisms 182, 282, 382 either send a signal to machines 100, 200, 300 to take no further action or just send no signal to machines 100, 200, 300 to take any action.

When each respective machine 100, 200 and/or 300 receives start signal 430, each modular arm 164 begins to rotate, preferably in a clockwise direction 432, such that modular arm 164, boom arm 120, and carriage 140 rotate around the load. Upper portion 162 of top frame 160 remains stationary and ring gear 167 rotates modular arm 164 in clockwise direction 432. As modular arm 164 begins to rotate, each sensing mechanism 182, 282 and/or 382 emits an infrared beam of light 434 towards load 500, 502, and/or 504 respectively to determine the height of each load and to determine where carriage 140 should stop moving upward. Specifically, load height is sensed while load 500, 502, and/or 504 is being wrapped. The load height of each load 500, 502, and/or 504 may be different. When sensing mechanisms 182, 282, and/or 382 senses that it is over (or above) respective load 500, 502, and/or 504, carriage 140 travel in the upward direction is stopped to prevent wrapping above the height of the load.

Sensing mechanisms 182, 282, 382 may further be used to calculate the height and/or weight of each load 500, 502, 504 being wrapped. System 10 may transmit this information from sensing mechanisms 182, 282, 382 to one or more of control boxes 400, 403 or otherwise display it to an operator to provide the operator with information about the loads 500, 502, 504 being wrapped.

Clamp 150 holds film 142 against the load such that film 142 does not need to be manually attached to the load prior to starting machine 100. Stretch film 142 passes through carriage 140 threading past at least two rubber rollers, primary roller 144 and secondary roller 146, to stretch film 142 prior to applying film 142 to the load. Secondary roller 146 has a rotational speed geared faster than primary roller 144 such that secondary roller 146 pulls film 142 from primary roller 144 stretching film 142 between rollers 144 and 146. For example, prestretch carriage 140 may stretch approximately 10" of film 142 into approximately 40" of prestretch film 142. Stretching film 142 prior to applying film 142 to the load decreases the amount of film 142 necessary to wrap the load and also activates the film memory effect causing film 142 to want to stretch back to its original length after it is applied to the load, thereby film 142 tightens on the load and holds the load securely.

Prestretch carriage 140 applies a spiraling layer of pre-stretched film 142 to the load encapsulating the load in film 142. In one embodiment, the spiraling layer starts at the load bottom 508. Specifically, as the load is wrapped, carriage 140 moves along boom arm 120 between boom arm top 124 and boom arm bottom 126 to apply film 142 to the load. Preferably, carriage 140 applies film 142 from bottom 508 to load top 506. Further, as carriage 140 wraps the load with film 142, the guides of bracket 128 enable carriage 140 to move along boom arm 120 in a substantially straight manner.

As the load is wrapped, the sensor on carriage 140 may read the distance between the cam and the sensor. As the cam moves further from the sensor, the prestretch carriage motor turns faster and feeds film 142 faster and the dancer bar assembly 151 feeds film 142 at corners of the load to prevent film 142 from tearing. While the load is being wrapped, carriage door 190 pushes film 142 against rollers 144 and 146 to maintain contact between film 142 and rollers 144 and 146 and further to maintain prestretch consistency.

Once load is substantially wrapped and carriage 140 is proximate bottom 508 of the load, stretch film wipe system 110 sweeps across film 142 to eliminate film tails. Specifically, arm 114 of system 110 extends out after the wrap cycle is completed, heat impulse wire 116 turns on momentarily to cut film 142, and wiper 118 extends out to wipe film on the load.

Further, safety photo eye 130 operates continuously or intermittently to ensure that nothing has interrupted the path between the reflector 136 and photo eye 130 to avoid objects being wrapped between film 142 and load. If something interrupts the path between photo eye 130 and reflector 136, the infrared beam of light will not be reflected by reflector 136, and photo eye 130 will transmit a signal stop the operation of machine 100.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A process of operating a system for stretch wrapping having a plurality of stretch wrapping machines, said process comprising:

(a) manually positioning at least one stationary load to be wrapped in an operational space in front of at least one of a first and a second stretch wrapping machines wherein the first stretch wrapping machine includes a first sensing mechanism in communication with a master control for said master control to receive a signal indicating the presence of said load in the operational space of the first machine, and wherein the second stretch wrapping machine includes a second sensing mechanism in communication with the master control for said master control to receive a signal indicating the presence or absence of a load in the operational space of the second machine;

(b) positioning a roll of stretch wrap film onto each said stretch wrapping machine, wherein an extent of the stretch wrap film is threaded through a pre-stretch carrier between a primary and a secondary roller and which is secured to a boom attached to a stand of the machine and is configured to pre-stretch the film and wherein said carrier is configured to be activated to rotate around a load present in said operational space for applying the film to the load;

(c) inputting a start signal to the master control from a manual start switch in communication with said master control for an operator to command the system to start a stretch wrapping sequence of applying stretch wrap to said at least one load residing in said operational space of said machine;

(d) wherein, upon receiving the start signal from the start switch, the master control selectively sends a command to each of said stretch wrap machine having a load determined to be present in said operational space, to start a stretch wrap sequence by that respective stretch wrapping machine with a signal provided to a motor to rotationally drive the primary and secondary rollers of the pre-stretch carrier to thereby stretch an extent of film into a pre-stretched condition, and master control providing a signal to a motor for activating movement of said carrier around the load in the operational space thereby applying the pre-stretched film onto the stationary load at the position detected by the sensor, and wherein said master control simultaneously prevents the start of a stretch wrapping machine for which a load is absent from the respective operational space, wherein movement of the carrier is controlled by a motor activated by the master controller when the start signal is received by the master controller.

2. A process of operating a system for stretch wrapping according to claim 1, further comprising:

determining a height of each present load within an operational space of each of the plurality of stretch wrapping machines.

3. A stretch wrap system for wrapping loads in film, said stretch wrap system comprising:

at least two stretch wrapping machines, each stretch wrapping machine having a feed roll of stretch wrap film and a pre-stretch carrier, each said carrier being attached to an arm assembly configured to move in a stretch wrapping operation of applying the pre-stretched film to encase a load residing in a wrapping zone of the system;

each stretch wrapping machine having a sensing mechanism adapted to detect the presence of a load in said wrapping zone of the respective stretch wrapping machine and to transmit a load presence signal indicating the presence of a load in the wrapping zone;

a master controller in communication with each sensing mechanism and adapted to receive the load presence signal from each sensing mechanism;

a start button adapted to transmit a start signal to the master controller by an operator providing a command to the master controller to start a stretch wrapping sequence of applying stretch wrap to said at least one load;

wherein the master controller is adapted such that upon receiving the start signal, the master controller selectively delivers a signal to start a stretch wrapping sequence of only each stretch wrapping machine from which the associated sensing mechanism has sent the load presence signal to the master controller and wherein said master control simultaneously prevents the start of a stretch wrapping machine having no load in the wrapping zone of said machine;

wherein each said machine further comprises at least one stand and at least one base coupled thereto and wherein the pre-stretch carrier is secured to a boom attached to the stand and movement of the carrier is controlled by a motor activated by the master controller when the master controller receives a start signal.

4. The stretch wrap system of claim 3, wherein each said machine further comprises at least one wipe system comprising at least one arm adapted to extend out toward the load, at least one heat impulse wire adapted to turn on to cut the film, and at least one wiper adapted to extend out to wipe the film, wherein said wiper is at least one of a brush and a bumper.

5. The stretch wrap system of claim 3, wherein each said machine further comprises a top frame comprising at least one modular arm, an upper portion, and a ring gear coupled therebetween such that said at least one modular arm is rotatable to provide movement of said carrier around a load.

6. The stretch wrap system of claim 3, wherein each said machine further comprises a boom arm comprising a carriage holder, a carriage coupled to said carriage holder, and a guide adapted to maintain alignment of said carriage with said boom arm.

7. The stretch wrap system of claim 6, wherein said carriage includes said pre-stretch carrier configured to stretch the film into prestreched film and is further adapted to move along said boom arm to apply a spiraling layer of the prestretched film to the load, said carriage comprises a top plate comprising a plurality of ring gears, an opposing bottom plate, at least one primary roller and at least one secondary roller coupled between said top plate and said bottom plate, at least one carriage cover to at least partially cover said top plate, and a door adapted to push the film against said primary and secondary rollers to maintain contact between the film and said rollers, wherein said master controller commences said stretch wrap sequence with a signal activating rotation of the primary and secondary rollers of the pre-stretch carrier to stretch an extent of film into a pre-stretched condition and providing a signal to activate movement of said carrier to apply stretch wrap to a load identified as residing within the wrapping zone.

8. The stretch wrap system of claim 6, wherein said carriage further comprises a dancer bar assembly comprising a dancer bar and a cam coupled to said dancer bar, said dancer bar assembly is adapted to allow more of the film to feed at corners of the load.

9. The stretch wrap system of claim 3, wherein each said sensing mechanism comprises at least one photo eye.

10. The stretch wrap system of claim 3, wherein each said sensing mechanism further senses a height of said load.

11. The stretch wrap system of claim 10, wherein each said sensing mechanism uses one or more infrared light signals to determine the presence and height of said load.

12. A stretch wrap system for wrapping pallet loads with film, said stretch wrap system comprising:

a plurality of stretch wrapping machines, each stretch wrap machine being positioned adjacent a respective wrapping zone configured for receiving a stationary load placed by an operator, each stretch wrapping machine having a feed roll of dispensable stretch wrap film and a pre-stretch carrier, wherein stretch wrap film dispensed from the feed roll passes through the pre-stretch carrier to create an extent of film that is stretched;

each said machine having a modular arm assembly configured to be driven into movement to revolve around the wrapping zone to apply the stretched film from the pre-stretch carrier onto a load present in said wrapping zone;

each stretch wrapping machine having a sensing mechanism configured to detect the presence of a stationary load in said wrapping zone of the respective stretch wrapping machine and to transmit to a master controller a load presence signal indicating the absence or presence of a load in the wrapping zone;

said master controller is configured to receive a signal from a start switch activated by an operator, and said master controller is electrically coupled to each machine of said plurality of stretch wrapping machines to communicate, independently for each machine, a signal to start a drive assembly of the pre-stretch carrier and movement of said modular arm assembly to rotate about the wrapping zone for applying the film to said load residing in the wrapping zone;

wherein the master controller, when receiving a signal from the start switch, selectively identifies which of the plurality of stretch wrapping machines is to be activated and delivers signal to each such machine to activate the drive assembly of the pre-stretch carrier and to activate movement of the modular arm assembly to apply the pre-stretched film from the carrier onto a stationary load present in said wrapping zone;

wherein each said machine further comprises at least one stand and at least one base coupled thereto and wherein the pre-stretch carrier is secured to a boom attached to the stand and movement of the carrier is controlled by a motor activated by the master controller when the master controller receives a start signal.

13. A system for applying stretch wrap to a stationary load placed into a wrapping zone and manually activated at an activation switch, the system comprising, a plurality of stretch wrap machines, each being adjacent a respective wrapping zone configured for receiving a stationary load manually placed into position;

each stretch wrap machine having a pre-stretch assembly for dispensing stretch wrap from a feed roll and configured to be actuated to stretch film dispensed from the feed roll;

each stretch wrap machine having a modular arm assembly configured to apply the film from the pre-stretch assembly by spirally wrapping a load with stretched film;

at least one sensing mechanism configured to detect the presence of a load in the wrapping zone of each respective stretch wrapping machine and transmit a signal to said at least one controller to identify presence of a load in said wrapping zone;

an activation switch configured to be activated by an operator, wherein a signal from said manual activation switch is received by said at least one controller;

wherein, after receiving a signal from said activation switch, said at least one controller selectively delivers a signal to each said stretch wrap machine having a load in said wrapping zone, said signal from the controller initiates a wrapping sequence by activating the pre-stretch assembly and the modular arm assembly to apply pre-stretched wrap to a respective load associated with each said machine;

wherein each said machine further comprises at least one stand and at least one base coupled thereto and wherein the pre-stretch carrier is secured to a boom attached to the stand and movement of the carrier is controlled by a motor activated by the master controller when the master controller receives a start signal.

* * * * *